United States Patent [19]

Huisma

[11] Patent Number: 4,603,709

[45] Date of Patent: Aug. 5, 1986

[54] DEVICE IN A VACUUM TRANSPORTATION SYSTEM FOR LIQUIDS, PREFERABLY A VACUUM SEWAGE SYSTEM

[75] Inventor: Camiel Huisma, Airdrie, Canada

[73] Assignee: Oy Wartsila AB, Helsinki, Finland

[21] Appl. No.: 698,689

[22] Filed: Feb. 6, 1985

[30] Foreign Application Priority Data

Feb. 10, 1984 [SE] Sweden ..... 8400707

[51] Int. Cl.[4] ..... F16K 31/12; F16K 31/128

[52] U.S. Cl. ..... 137/205; 4/323; 137/393; 137/395; 137/403; 137/403; 141/65; 141/198; 222/66

[58] Field of Search ..... 137/205, 386, 393, 403, 137/395, 413, 414; 4/323; 141/65, 198; 222/66; 251/28

[56] References Cited

U.S. PATENT DOCUMENTS

| | | | |
|---|---|---|---|
| 3,654,953 | 4/1972 | Hagdorn | 137/403 |
| 3,746,032 | 7/1973 | Wallgren | 4/323 |
| 3,777,778 | 12/1973 | Janu | 4/323 |
| 3,807,431 | 4/1974 | Svanteson | 137/413 |
| 4,188,968 | 2/1980 | Trobaugh et al. | 137/403 |
| 4,297,751 | 11/1981 | Olin et al. | 137/205 |
| 4,357,719 | 11/1982 | Badger et al. | 4/323 |

*Primary Examiner*—G. L. Walton

*Attorney, Agent, or Firm*—Alfred E. Miller

[57] ABSTRACT

The invention relates to a device in a vacuum transportation system for liquids, preferably a vacuum sewage system, comprising a transportation conduit (12) which is under vacuum and via a normally closed valve (13) and a suction pipe (14) connected to a liquid collecting container (10). The closing movement for the valve (13) is activated by the change in pressure which occurs when air entering after the liquid flows into the system.

7 Claims, 1 Drawing Figure

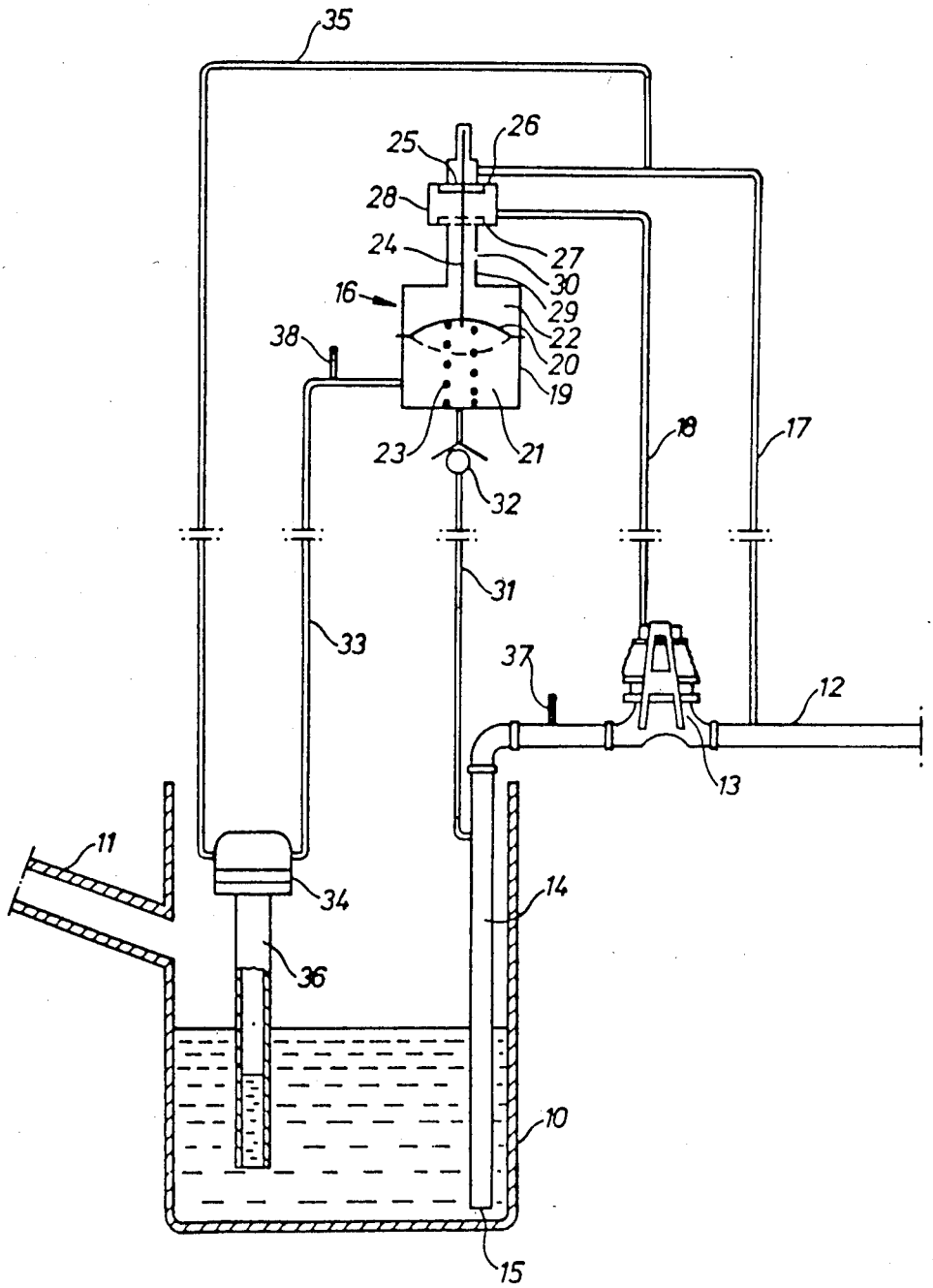
35
25
26
28
24
27
30
16
29
22
38
20
19
23
21
18
17
32
31
33
37
12
13
11
34
14
36
10
15

DEVICE IN A VACUUM TRANSPORTATION SYSTEM FOR LIQUIDS, PREFERABLY A VACUUM SEWAGE SYSTEM

This invention relates to a device in a vacuum transportation system for liquids, preferably a vacuum sewage system, comprising a transportation conduit which is under vacuum and through a normally closed valve and a suction pipe is connected to a liquid collecting container.

Devices of the above type are previously known. Thus, U.S. Pat. No. 3,807,431 discloses such a device in which the opening movement of the valve is achieved by means of a float mechanism. In this device, an upper, predetermined position of the float opens the connection to the vacuum conduit whereby the sewage in the container is sucked away by means of a vacuum. When the float, which sinks when the sewage disappears, has reached a lower position the connection is closed and sewage is again collected in the container and the float again rises until the process is repeated. This works well under some conditions but the method is limited to systems in which large volumes are collected so that the level changes are sufficiently large.

Another device of the type referred to above is described in Canadian Patent No. 1,073,317 and U.S. Pat. Nos. 3,654,953 and 3,777,778. In this device instead of operating the valve by level changes a system is used in which the static pressure of the sewage is measured. This is achieved by means of a flexible diaphragm which by means of a conduit is connected to the collecting container. When the sewage rises in the container the pressure increases in the conduit so that the diaphragm, situated in the upper part of the conduit, will bulge and act on a pilot valve, which opens a connection between the vacuum conduit and the activating means of the valve, and the valve will open. The closing movement of the valve can be achieved by means of a timer, which is started when the flexible diaphragm returns to its initial position, i.e. when the static pressure has fallen below a predetermined value.

According to another known embodiment it is possible for the opening movement of the valve as well as for its closing movement to use two separate devices sensing the static pressure, in which one device initiates the opening function whereas the other device initiates the closing function.

An object of this invention is to offer another type of device making it possible to exactly control the opening of the valve, the valve opening for instance when a given upper liquid level has been indicated and then being retained in the open position at least until air starts being sucked into the vacuum conduit, which occurs when the liquid surface falls below the level corresponding to the level of the inlet opening of the suction pipe.

The invention will now be described by way of example with reference to the accompanying drawing which is a schematic cross section through a device according to the invention.

In the FIGURE, the reference numeral 10 is a container for collecting sewage which flows to the container through conventional gravity conduits 11. These are connected in a conventional manner to sanitary installations in the buildings.

From the upper part of the container 10 a vacuum conduit 12 extends to a collecting place, a purification plant or to a conventional sewage system. Vacuum is, as usual maintained in the conduit 12 by means of some suitable vacuum creating device located downstream of the conduit. Through a valve 13 the vacuum conduit is connected to a suction pipe 14 extending vertically downwards from the upper part of the container 10 and having an inlet opening 15 close to the bottom of the container. In the shown embodiment, the valve 13 is in conventional way operable by means of vacuum, the vacuum in the conduit 12 through a closing activator 16 being transmitted to the valve to open it thereby establishing a connection between the suction pipe 14 and the vacuum conduit 12. Between the vacuum conduit and the activator is a hose 17, and between the activator and the valve there is another hose 18. The activator 16 consists of a cylinder 19 which through a diaphragm 20 is divided into a lower chamber 21 and an upper chamber 22. The diaphragm 20 is under the action of a spring 23 which tends to press the diaphragm upwards. Further, the diaphragm has a central upwardly directed spindle 24 extending through the chamber 22 and in its upper part supporting a sealing collar 25. This collar is intended to co-act with an upper sealing surface 26 and a lower sealing surface 27 in a housing 28 which is a continuation of the cylinder 19. The housing 28 is connected to the cylinder 19 through a throat part 29. The hose 17 is connected to the upper part of the housing 28 whereas the hose 18 is connected to the lower part of the housing 28. The chamber 22 and the throat part 29, respectively, are connected to atmosphere through an opening 30.

The lower chamber 21 is through a hose 31, provided with a check valve 32, connected to the suction pipe 14. Further, by means of a hose 33 over an opening activator 34 the chamber 21 is connected to a hose 35. This hose 35 is directly connected to the hose 17.

The opening activator 34 is preferably a device of the type which has been described in some of the patent publications referred to above, i.e. it comprises a diaphragm, not shown, which is arranged in a conduit 36 and under the influence of the static pressure of the liquid in the container 10 opens a connection between the hoses 33 and 35, respectively. The suction pipe 14 and the hose 33 are connected to atmosphere through openings 37 and 38, respectively, the opening 38 being provided with a throttle.

The device operates in the following manner.

Normally, the valve 13 is closed and there is vacuum both in the conduit 12 and in the hoses 17 and 35. The opening activator 34 is inactive, which means that there is atmospheric pressure in the hose 33 and hence also in the chamber 21. This means that the diaphragm 20 is in its upper position in which the sealing collar 25 seals against the surface 26 and vacuum prevails above the sealing. In the upper part of the suction pipe 14, as well as in the hose 31, the throat part 29 and the hose 18 there is atmospheric pressure.

When sewage successively is fed through the conduit 11 the static pressure in the conduit 36 increases and at a predetermined level a connection between the hoses 33 and 35 is opened. Consequently a vacuum is transmitted to the chamber 21 although this vacuum to some degree is reduced because of the throttled opening 38 to the atmosphere.

By the vacuum created in the chamber 21 the check valve 32 closes and the diaphragm 20 is forced downwards accompanied by the spindle 24. The sealing 25 goes out of engagement with the surface 26 and is rapidly moved to seal against the surface 27. This means that vacuum is transmitted from the hose 17 to the hose 18 and the valve 13 opens.

This, in turn, means that the suction pipe 14 is connected to the vacuum conduit 12 so that the sewage in the container 10 will be sucked out through the opening 15 and further transported into the conduit 12. During this transportation air is mixed into the sewage by the opening 37.

When the level sinks in the container 10 also the static pressure in the conduit 36 decreases, which means that the activator 34 again closes the connection between the hoses 33 and 35. Thus the pressure in the chamber 21 will increase since air is allowed to enter through the opening 38 to the hose 33.

During the transportation of liquid vacuum prevails also in the hose 31, and this vacuum is a function of the height of the liquid column and the flow resistance in the suction pipe. The throttle in the opening 38 is so designed that when the opening activator 34 has closed the connection between the hoses 33 and 35 the vacuum in the hose 31 is capable of keeping the check valve 32 open and the diaphragm 20 in its lower position, although air is entering.

When the liquid in the container 10 has reached a level which is equal to that of the opening 15 air will suddenly enter through the said opening. When this air column reaches the point at which the hose 31 is connected to the suction pipe 14 a sudden increase of the air pressure occurs in the hose 31. This means that the check valve 32 closes and that the pressure increases in the chamber 21.

Thus, the diaphragm 20 is pressed upwards by the spring 23 and the sealing is moved to abut the surface 26 thereby interrupting the communication between the hoses 17 and 18. Air of atmospheric pressure flows through the opening 30 into the hose 18 thereby closing the valve 13. Thus, sewage can again be collected in the container 10.

It is also possible within the scope of the invention to design the device with a time-controlled function so that the valve is retained in its open position during a given time after the air has started flowing into the suction pipe 14. In that case the opening 37 can be dispensed with.

It is also possible to transmit the pressure changes to an electric signal in order to operate the valve in any suitable way, for instance by means of electric and/or pneumatic means.

I claim:

1. A vacuum transportation system for liquids comprising a liquid collecting container, a transportation conduit adapted to be maintained under vacuum, a suction pipe having an entrance opening in said container and connecting said container to said transportation conduit, a normally closed pressure/vacuum valve between said suction pipe and said transportation conduit, said valve having a pressure/vacuum operated control means, a pressure regulating unit capable of providing the control means for said pressure/vacuum valve and for, respectively, opening and closing said valve, a fluid pressure operated actuator responsive to the liquid level in said container, and pressure regulating valve means responsive to a certain pressure drop in said suction pipe occurring due to air entering said suction pipe when the liquid level in said container sinks below the level of the entrance opening of said suction pipe, said regulating means being arranged and connected via a pipe means connected at a point between the entrance opening of said suction pipe and said pressure/vacuum valve to permit the air entering the entrance opening to act upon said pressure regulating unit for closing said pressure/-vacuum valve.

2. A transportation system according to claim 1, further comprising a time control means in which said pressure drop is arranged to influence said pressure regulating unit over said time control means arranged to delay the closing of said valve.

3. A transportation system according to claim 1, in which the control means for said pressure/vacuum valve has a connection to said transportation conduit, said connection including a pilot valve arranged to direct, alternatively, vacuum from said transportation conduit and air of atmospheric pressure to the control means of said pressure/vacuum valve, said pilot valve being operated by said pressure regulating unit.

4. A transportation system according to claim 1, in which said pressure regulating unit further comprises a chamber connected to said suction pipe and including a pressure operated member capable of closing and opening a connection between said transportation conduit and the control means of said pressure/vacuum valve.

5. A transportation system according to claim 4, in which the connection between said chamber of the pressure regulating unit and said pipe means is provided with a check valve preventing flow towards said chamber.

6. A transportation system according to claim 4, wherein said chamber of the pressure regulating unit is connected also to said actuator for receiving vacuum therefrom.

7. A transportation system according to claim 4, in which said pressure regulating unit is provided with a spring member urging said pressure regulating unit into a position to effect the closing of said pressure/vacuum valve.

* * * * *